US011346181B2

(12) United States Patent
Morrow

(10) Patent No.: US 11,346,181 B2
(45) Date of Patent: May 31, 2022

(54) ENGINEERED PRODUCTION LINER FOR A HYDROCARBON WELL

(71) Applicant: ExxonMobil Upstream Research Company, Spring, TX (US)

(72) Inventor: Timothy I. Morrow, Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 17/027,956

(22) Filed: Sep. 22, 2020

(65) Prior Publication Data

US 2021/0164325 A1 Jun. 3, 2021

Related U.S. Application Data

(60) Provisional application No. 62/942,545, filed on Dec. 2, 2019.

(51) Int. Cl.
*E21B 34/10* (2006.01)
*E21B 43/08* (2006.01)
(Continued)

(52) U.S. Cl.
CPC ..... *E21B 34/10* (2013.01); *E21B 34/063* (2013.01); *E21B 43/08* (2013.01); *E21B 43/27* (2020.05); *E21B 2200/08* (2020.05)

(58) Field of Classification Search
CPC ..... E21B 34/10; E21B 34/063; E21B 43/27; E21B 43/08; E21B 2200/08
See application file for complete search history.

(56) References Cited

U.S. PATENT DOCUMENTS 2,327,051 A * 8/1943 Lyons ..... E21B 43/26 166/222
3,333,635 A * 8/1967 Crawford ..... E21B 33/134 166/276

(Continued)

OTHER PUBLICATIONS

Sau, Rajes et al., Bullhead Stimulation and First Real-Time Fiber Optic Surveillance in Extended-Reach Horizontal Laterals to Maximize Reservoir Recovery in a Giant Offshore Carbonate Oil Field Abu Dhabi, Society of Petroleum Engineers, 2019, 10 pages, SPE 197752.

(Continued)

*Primary Examiner* — Aaron L Lembo
(74) *Attorney, Agent, or Firm* — ExxonMobil Upstream Research Company—Law Department

(57) ABSTRACT

Techniques described herein relate to a well completion including an engineered production liner extending into a reservoir. The engineered production liner includes limited-entry liner (LEL) valves configured to open to allow an acid solution to jet into the reservoir during an acid stimulation process, and close to prevent production fluid from flowing through the LEL valves when the well completion is put into production. The engineered production liner also includes pre-packed chemically-infused material (CIM) cartridges including production chemicals, and openings that align with the pre-packed CIM cartridges. The openings are plugged during the acid stimulation process to force the acid solution to flow through the LEL valves. The pre-packed CIM cartridges and the openings are configured to allow the production fluid to absorb a portion of the production chemicals as it flows from the reservoir into the engineered production liner when the well completion is put into production.

20 Claims, 5 Drawing Sheets

(51) Int. Cl.
*E21B 34/06* (2006.01)
*E21B 43/27* (2006.01)

(56) References Cited

U.S. PATENT DOCUMENTS

| | | | | |
|---|---|---|---|---|
| 8,517,099 | B2 * | 8/2013 | Mathiesen | E21B 34/08 166/263 |
| 9,759,062 | B2 * | 9/2017 | Deffenbaugh | E21B 47/14 |
| 9,810,040 | B2 * | 11/2017 | Morrow | C09K 8/528 |
| 9,816,373 | B2 * | 11/2017 | Howell | E21B 47/16 |
| 9,863,222 | B2 * | 1/2018 | Morrow | E21B 47/10 |
| 9,879,525 | B2 * | 1/2018 | Morrow | E21B 47/007 |
| 10,030,473 | B2 * | 7/2018 | Tolman | E21B 34/103 |
| 10,053,968 | B2 * | 8/2018 | Tolman | E21B 43/119 |
| 10,100,635 | B2 * | 10/2018 | Keller | E21B 47/125 |
| 10,138,713 | B2 * | 11/2018 | Tolman | E21B 41/00 |
| 10,508,536 | B2 * | 12/2019 | Morrow | E21B 43/11 |
| 10,697,287 | B2 * | 6/2020 | Romer | E21B 47/13 |
| 2003/0141061 | A1 * | 7/2003 | Hailey, Jr. | E21B 34/063 166/278 |
| 2005/0126776 | A1 * | 6/2005 | Russell | E21B 43/082 166/229 |
| 2005/0274522 | A1 * | 12/2005 | Surjaatmadja | E21B 43/26 166/308.1 |
| 2007/0084605 | A1 * | 4/2007 | Walker | E21B 34/063 166/313 |
| 2009/0065206 | A1 * | 3/2009 | Russell | E21B 43/082 166/276 |
| 2009/0101349 | A1 * | 4/2009 | Johnson | E21B 43/26 166/307 |
| 2009/0145660 | A1 * | 6/2009 | Johnson | E21B 17/003 175/25 |
| 2012/0125626 | A1 * | 5/2012 | Constantine | E21B 34/063 166/373 |
| 2014/0158357 | A1 * | 6/2014 | Lyashkov | E21B 43/114 166/297 |
| 2014/0356533 | A1 * | 12/2014 | Harmat | B05C 7/02 427/244 |
| 2015/0060056 | A1 * | 3/2015 | Kumaran | E21B 44/005 166/250.01 |
| 2016/0177672 | A1 * | 6/2016 | Morrow | C09K 8/528 166/300 |
| 2018/0328139 | A1 * | 11/2018 | Mhaskar | E21B 43/08 |
| 2018/0347322 | A1 * | 12/2018 | Osunjaye | E21B 47/11 |
| 2019/0292877 | A1 * | 9/2019 | Flores Perez | E21B 34/063 |
| 2021/0317727 | A1 * | 10/2021 | Chen | E21B 33/146 |

OTHER PUBLICATIONS

Sau, Rajes et al., Advanced ERD Lower Completion Technology Performance Update in a Giant Offshore Field UAE, Society of Petroleum Engineers, 2019, 9 pages, SPE 197418.

Othman, Alaa Amin et al., A Robust Production Engineering Strategy for Extended Reach Well for Sustained Performance, Society of Petroleum Engineers, 2018, 12 pages, SPE 193205.

Szymczak, Stephen et al., Gulf of Mexico Frac-Pack with a 10% Loading of an Intermediate Strength, Chemical-Infused Proppant-Sized Particle Designed to Provide Long Term Inhibition for Barium Sulfate Scale, Society of Petroleum Engineers, 2014, 10 pages, SPE 168615.

Szymczak, Stephen et al., Well Stimulation Using a Solid, Proppant-Sized, Paraffin Inhibitor to Reduce Costs and Increase Production for a South Texas, Eagle Ford Shale Oil Operator, Society of Petroleum Engineers, 2014, 6 pages, SPE 168169.

Wornstaff, V. et al., Solid Paraffin Inhibitors Pumped in Hydraulic Fractures Increased Oil Recovery in Viking Wells, Society of Petroleum Engineers, 2014, 7 pages, SPE 168147.

* cited by examiner

100

100

100

500

ENGINEERED PRODUCTION LINER FOR A HYDROCARBON WELL

CROSS-REFERENCE TO RELATED APPLICATION

This application claims the benefit of U.S. Provisional Application 62/942,545 filed Dec. 2, 2019 entitled ENGINEERED PRODUCTION LINER FOR A HYDROCARBON WELL, the entirety of which is incorporated by reference herein.

FIELD

The techniques described herein relate to the field of well completions and downhole operations. More particularly, the techniques described herein relate to an engineered production liner for a hydrocarbon well. The engineered production liner includes limited-entry liner (LEL) valves for enhanced acid stimulation and cartridges pre-packed with chemically-infused material (CIM) for improved production performance.

BACKGROUND

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Modern society is greatly dependent on the use of hydrocarbons for fuels and chemical feedstocks. Hydrocarbons are generally found in subsurface rock formations known as "reservoirs." Removing hydrocarbons from reservoirs depends on numerous physical properties of the rock formations, such as the permeability of the rock containing the hydrocarbons, the ability of the hydrocarbons to flow through the rock formations, and the proportion of hydrocarbons present, among others.

Because many newly-discovered reservoirs are located in challenging environments, a relatively new drilling technique, referred to as extended reach drilling (ERD), is often used to drill wells with very long horizontal (or highly-deviated) sections, i.e., on the order of 300 meters (m) to 3,000 m long. These wells are sometimes referred to as "extended-reach wells" or "ultra-extended-reach wells," depending on the length of the horizontal sections. Extended-reach and ultra-extended-reach wells can present unique challenges associated with construction, completion, and production of the wells. Such challenges may vary based on the length of the well, variations in the subterranean formations that may be experienced along the length of the well, and variations in the reservoir fluids that may be encountered along the length of the well. Because of these and other factors, various techniques have been developed to assist with flow control issues associated with the construction, completion, and production of such wells.

One technique that helps with flow control issues is known as "stimulation." Stimulation is a process by which the flow of hydrocarbons between a formation and a wellbore is improved. This can be performed by any number of techniques, such as fracturing a rock surrounding the wellbore with a high-pressure fluid, injecting a surfactant into a reservoir, or injecting steam into the reservoir to lower the viscosity of the hydrocarbons. One technique involves injecting acid through the wellbore into the surrounding formation. This helps to remove debris from the wellbore and increases the flow from the formation, for example, by forming wormholes in the formation. Wormholes are small holes or cracks formed by acid attack on certain types of rock.

A relatively new type of completion, referred to as a limited-entry liner (LEL) completion, is designed to provide enhanced acid stimulation and even production profiles along the length of the well. LEL completions are particularly useful for complex extended-reach and ultra-extended-reach wells, such as wells developed for tight, thin carbonate reservoirs in the Middle East. An LEL completion includes a string of blank pipes with small holes, i.e., about 3 millimeters (mm) to 4 mm in diameter, drilled approximately every 30 meters. The LEL holes serve two purposes. First, the LEL holes create a high-velocity jet of acid into the formation during stimulation. Second, the LEL holes provide a mechanical diversion to help create a relatively even distribution of inflow and outflow along the wellbore.

Another technique that helps with flow control issues involves injecting chemically-infused materials (CIM), such as chemically-infused proppant, into the production fluid within the well. The CIM may include different production chemicals that can be used to address a variety of flow control issues. For example, the CIM may include a scale inhibitor, asphaltene inhibitor, and/or hydrogen sulfide ($H_2S$) scavenger to control the buildup of inorganic scale, asphaltenes, and/or $H_2S$, respectively, within the production tubing. As another example, the CIM may include corrosion inhibitor to reduce the effects of corrosion within the well.

CIM is typically deployed in frac-pack or gravel-pack completions where sand control and/or fracture stimulation are needed. However, some wells that do not require sand control or fracture stimulation are still prone to corrosion and the buildup of inorganic scale, asphaltenes, and $H_2S$. In such wells, CIM can be deployed using cartridges pre-packed with CIM. However, it is difficult to integrate pre-packed CIM cartridges with LEL completions. It is undesirable to cover up the LEL holes with pre-packed CIM cartridges, because doing so slow the flow of the acid through the LEL holes and, thus, hinder the acid stimulation process. Moreover, if the pre-packed CIM cartridges are simply slipped over the blank pipes next to the LEL holes, some production fluid may likely bypass the pre-packed CIM cartridges altogether and enter the liner through the LEL holes without absorbing any production chemicals. Therefore, there is a need for a reliable, cost-effective technique for integrating pre-packed CIM cartridges with new LEL completions.

SUMMARY

An embodiment described herein provides a well completion including an engineered production liner extending into a reservoir. The engineered production liner includes a number of limited-entry liner (LEL) valves configured to open to allow an acid solution to jet into the reservoir during an acid stimulation process, and close to prevent production fluid from flowing through the LEL valves when the well completion is put into production. The engineered production liner also includes a number of pre-packed chemically-infused material (CIM) cartridges including production chemicals and a number of openings that align with the pre-packed CIM cartridges. The openings are plugged during the acid stimulation process to force the acid solution to flow through the LEL valves. In addition, the pre-packed CIM cartridges and the openings are configured to allow the production fluid to absorb a portion of the production chemicals as the production fluid flows from the reservoir into the engineered production liner when the well completion is put into production.

Another embodiment described herein provides a method for enhancing acid stimulation and improving production performance within a well using an engineered production liner. The method includes stimulating a reservoir by plugging a number of openings that align with a number of pre-packed CIM cartridges installed along an engineered production liner of a well, and injecting an acid solution into a reservoir via a number of LEL valves installed along the engineered production liner. The LEL valves are configured to open when an injection rate of the acid solution is sufficient to increase a pressure differential between the well and the reservoir such that the pressure differential exceeds a threshold pressure differential for opening the LEL valves. The method also includes decreasing a pressure within the well such that the pressure differential no longer exceeds the threshold pressure differential and the LEL valves close. The method further includes producing production fluid from the reservoir via the pre-packed CIM cartridges and the openings. Moreover, the pre-packed CIM cartridges include production chemicals, and the production fluid flowing through the pre-packed CIM cartridges absorbs a portion of the production chemicals.

Another embodiment described herein provides an engineered production liner. The engineered production liner includes a number of LEL valves that are configured to open to allow an injected fluid to flow from an interior of the engineered production liner to an exterior of the engineered production liner when a pressure differential between the interior and the exterior exceeds a threshold pressure differential for opening the plurality of LEL valves, and close when the pressure differential no longer exceeds the threshold pressure differential. The engineered production liner also includes a number of pre-packed CIM cartridges including production chemicals, and a number of openings that align with the pre-packed CIM cartridges. The pre-packed CIM cartridges and the openings are configured to allow a production fluid to absorb a portion of the production chemicals as the production fluid flows from the exterior to the interior of the engineered production liner.

DESCRIPTION OF THE DRAWINGS

The foregoing and other advantages of the present techniques may become apparent upon reviewing the following detailed description and drawings of non-limiting examples in which.

Figure 1:
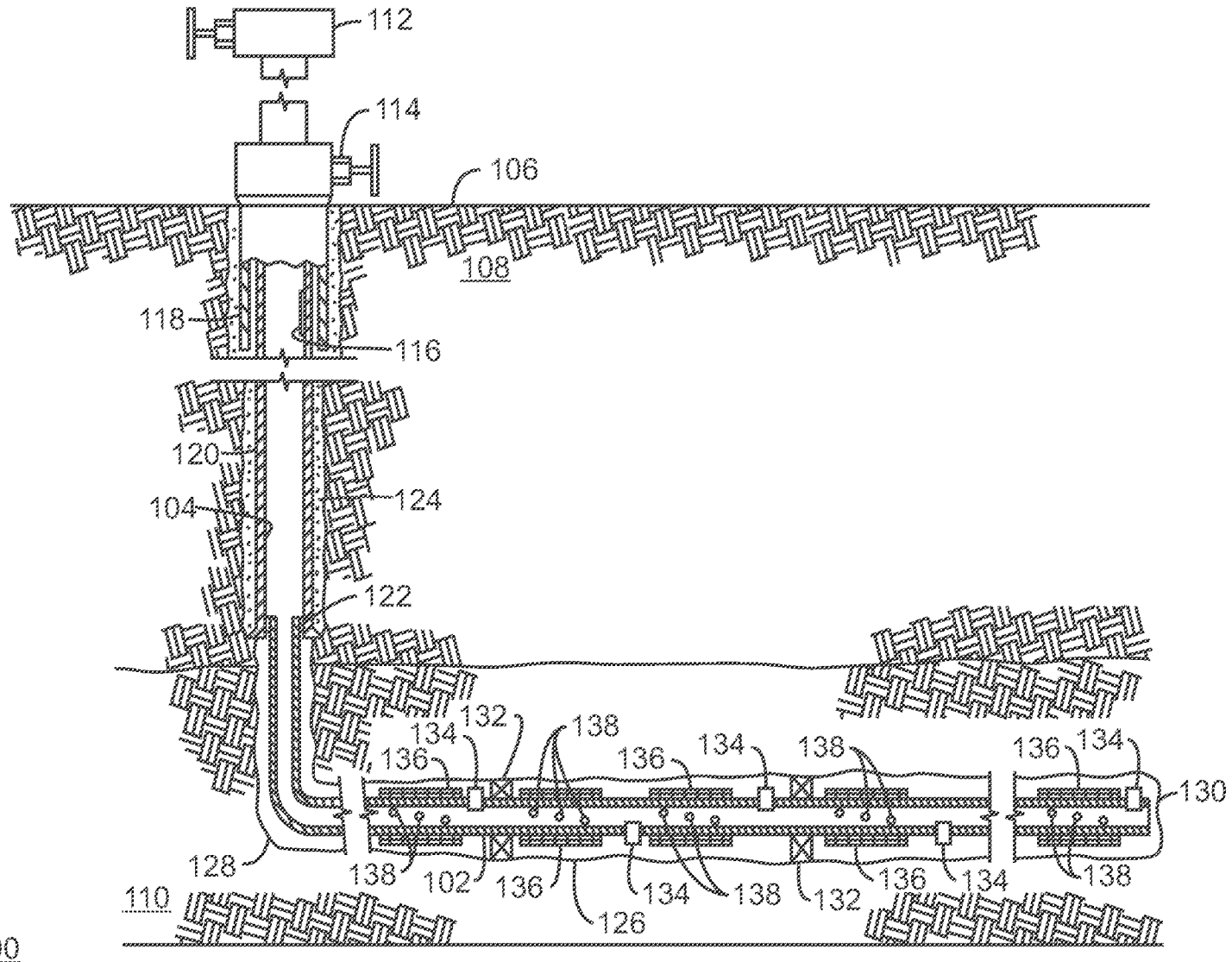
FIG. 1 is a cross-sectional schematic view of a well that includes an engineered production liner for enhanced acid stimulation and improved production performance.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The terms "about," "approximately," and "around" mean a relative amount of a material or characteristic that is sufficient to provide the intended effect. The exact degree of deviation allowable in some cases may depend on the specific context, e.g., ±1%, ±5%, ±10%, ±15%, etc. It should be understood by those of skill in the art that these terms are intended to allow a description of certain features described and claimed without restricting the scope of these features to the precise numerical ranges provided. Accordingly, these terms should be interpreted as indicating that insubstantial or inconsequential modifications or alterations of the subject matter described are considered to be within the scope of the disclosure.

The term "casing" refers to a protective lining for a wellbore. Any type of protective lining may be used, including those known to persons skilled in the art as liner, casing, tubing, etc. Casing may be segmented or continuous, jointed or unjointed, made of any material (such as steel, aluminum, polymers, composite materials, etc.), and may be expanded or unexpanded.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing subterranean formations. Note that the terms "formation," "reservoir," and "interval" may be used interchangeably, but may generally be used to denote progressively smaller subsurface regions, zones, or volumes. More specifically, a "formation" may generally be the largest subsurface region, while a "reservoir" may generally be a hydrocarbon-bearing zone or interval within the geologic formation that includes a relatively high percentage of oil and gas. Moreover, an "interval" may generally be a sub-region or portion of a reservoir. In some cases, a hydrocarbon-bearing zone, or reservoir, may be separated from other hydrocarbon-bearing zones by zones of lower permeability, such as mudstones, shales, or shale-like (i.e., highly-compacted) sands.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in oil and natural gas, such as $CH_4$, $C_2H_2$, $C_2H_4$, $C_2H_6$, $C_3$ isomers, $C_4$ isomers, benzene, and the like.

As used herein, a "joint" refers to a single unitary length of pipe. Tubing joints are generally around 6 meters to 12 meters long with a thread connection on each end.

The term "liner" refers to a casing string that does not extend back to the wellhead or surface but is, instead, anchored or suspended from inside the bottom of the previous casing string using a liner hanger, for example.

As used herein, the term "packer" refers to a type of sealing mechanism used to block the flow of fluids through a well or an annulus within a well. Packers can include, for example, open-hole packers, such as swelling elastomers, mechanical packers, or external casing packers, which can provide zonal segregation and isolation.

The term "substantially," when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

The terms "well" and "wellbore" refer to holes drilled vertically, at least in part, and may also refer to holes drilled with deviated, highly-deviated, and/or horizontal sections. The term also includes wellhead equipment, surface casing, intermediate casing, and the like, typically associated with oil and gas wells.

As used herein, a "well completion" is a group of equipment and operations that may be installed and performed to produce hydrocarbons from a subsurface reservoir. The well completion may include the casing, production liner, completion fluid, gas lift valves, and other equipment used to prepare the well to produce hydrocarbons.

The term "wormhole" refers to a high permeability channel that starts from a wellbore and propagates into an interval within a formation. In addition to forming naturally in some types of formations, wormholes can be generated during well stimulation processes by any number of techniques. For example, a corrosive fluid such as an acid may be used to generate wormholes in a carbonate reservoir. The development of wormholes may substantially enhance production in intervals within a reservoir.

Overview

The present techniques relate to an engineered production liner for a hydrocarbon well. The engineered production liner is a modified limited-entry liner (LEL) including one-directional LEL valves for enhanced acid stimulation and cartridges pre-packed with chemically-infused material (CIM) for improved production performance. During the acid stimulation process, perforations (or other openings) corresponding to the pre-packed CIM cartridges are plugged by diversion material, and the LEL valves are configured to open to allow a high-velocity jet of acid to flow from the well into the surrounding formation. During production, however, the diversion material no longer plugs the perforations, and the LEL valves are configured to close, effectively forcing all production fluid to flow through the pre-packed CIM cartridges. As the production fluid flows through the pre-packed CIM cartridges, the production fluid absorbs specific production chemicals that are useful for optimizing the production performance of the well. Furthermore, in some embodiments, the engineered production liner is configured to allow the chemically-infused material within the pre-packed CIM cartridges to be recharged, or replaced, once it is depleted, thus extending the useful lifetime of the engineered production liner.

A Hydrocarbon Well Including an Engineered Production Liner for Enhanced Acid Stimulation and Improved Production Performance FIG. 1 is a cross-sectional schematic view of a well 100 that includes an engineered production liner 102 for enhanced acid stimulation and improved production performance. The well 100 defines a bore 104 that extends from a surface 106 into a formation 108 within the earth's subsurface. The formation 108 may include several subsurface intervals, such as a hydrocarbon-bearing interval that is referred to herein as a reservoir 110. In some embodiments, the reservoir 110 includes mostly carbonate rock layers. However, the reservoir 110 may also include any other types of rock layers, such as cemented sand layers.

The well 100 includes a wellhead 112. The wellhead 112 includes a shut-in valve 114 that controls the flow of production fluid from the well 100. In addition, a subsurface safety valve 116, sometimes referred to as a "shut-in valve," is provided to block the flow of production fluid from the well 100 in the event of a rupture or a catastrophic event at the surface 106 or above the subsurface safety valve 116. The wellhead 112 couples the well 100 to other equipment (not shown), such as a pump and a tank holding acid or other aggressive fluids for a stimulation process. Furthermore, artificial lift equipment, such as a pump (not shown) or a gas lift system (not shown), may optionally be included in the well 100 to aid the movement of the production fluid from the reservoir 110 to the surface 106.

The well 100 is completed by setting a series of tubulars into the formation 108. These tubulars include several strings of casing, such as a surface casing string 118, an intermediate casing string 120, and a production casing string, which is referred to as the engineered production liner 102 according to embodiments described herein. In some embodiments, additional intermediate casing strings (not shown) are also included to provide support for the walls of the well 100. According to the embodiment shown in FIG. 1, the surface casing string 118 and the intermediate casing string 120 are hung from the surface 106, while the engineered production liner 102 is hung from the bottom of the intermediate casing string 120 using a liner hanger 122.

The surface casing string 118 and the intermediate casing string 120 are set in place using cement 124. The cement 124 isolates the intervals of the formation 108 from the well 100 and each other. Referring specifically to the engineered production liner 102, the engineered production liner 102 may also be set in place using a cement sheath. However, in the embodiment shown in FIG. 1, the well 100 is set as an open-hole completion, meaning that the production casing string, i.e., the engineered production liner 102, is not set in place using cement.

The exemplary well 100 shown in FIG. 1 is completed horizontally. A horizontal portion is shown at 126. The horizontal portion 126 has a heel 128 and a toe 130 that extends through the reservoir 110 within the formation 108. In some embodiments, the distance between the heel 128 and the toe 130 is on the order of around 300 meters, in which case the well 100 may be referred to as an extended-reach well. In other embodiments, the distance between the heel 128 and the toe 130 is on the order of around 3,000 meters, in which case the well 100 may be referred to as an ultra-extended-reach well.

The well 100 also includes a number of packers 132. The packers 132 are placed along the outer diameter of the engineered production liner 102. The packers 132 may be any suitable type of packer, such as, for example, a swellable packer fabricated from a swelling elastomeric material.

According to embodiments described herein, the engineered production liner 102 is a modified limited-entry liner (LEL). The limited-entry portion of the engineered production liner 102 begins at the heel 128 of the horizontal portion 126 and extends to the toe 130 of the horizontal portion 126. While typical LELs include small LEL holes, i.e., about 3 millimeters (mm) to 4 mm in diameter, drilled approximately every 30 meters, the modified LEL described herein includes one-directional valves 134, generally referred to herein as "LEL valves," in place of the LEL holes. Each LEL valve 134 may be designed such that the fluid outlet is about 3 mm to 4 mm in diameter when the LEL valve 134 is in the open position. In addition, similarly to typical LEL holes, the LEL valves 134 may be spaced approximately 15 meters to 30 meters apart along the length of the engineered production liner 102 (although the spacing between the LEL valves 134 may vary considerably depending on the details of the specific implementation).

The LEL valves 134 may include any suitable type of one-directional valve, such as a standard check valve or pressure-relief valve, that allows fluid to flow from the well 100 to the reservoir 110, but prevents fluid from flowing in the opposite direction. In various embodiments, the LEL valves 134 operate based on the pressure differential between the well 100 and the reservoir 110, where the pressure differential is defined as the pressure within the well 100 minus the pressure within the reservoir 110 proximate to the well 100. For example, in one embodiment, the LEL valves 134 are check valves including a ball that is held against a seal by a spring. When the pressure differential exceeds a certain threshold, the ball moves away from the seat, allowing fluid to flow around the ball. In the opposite direction, however, fluid flow is blocked by both the force of the spring and the back pressure on the ball. In various embodiments, the threshold pressure differential at which the LEL valves 134 may open is specifically tailored based on the details of the specific implementation, as described further herein.

The engineered production liner 102 also includes a number of pre-packed chemically-infused material (CIM) cartridges 136. In various embodiments, the pre-packed CIM cartridges 136 are pre-packed screens that may include CIM surrounded by stainless steel mesh, for example. Moreover, the CIM is material, such as proppant, that includes production chemicals. The production chemicals may include a variety of different chemicals that are suitable for addressing various production performance issues, such as flow control issues, within the well 100 or the surrounding reservoir 110. For example, the production chemicals may include some combination of scale inhibitors, corrosion inhibitors, $H_2S$ scavengers, asphaltene inhibitors, water-soluble tracers, and/or oil-soluble tracers, among others. Furthermore, the grain sizes of the CIM may be specifically tailored to give different resistances to inflow such that desired inflow profiles are maintained within the well 100.

In various embodiments, the pre-packed CIM cartridges 136 and the LEL valves 134 are installed on adjacent (or nearly adjacent) joints such that the joints with the pre-packed CIM cartridges 136 are proximate to the joints with the LEL valves 134, as shown in FIG. 1. In some embodiments, the engineered production liner 102 includes a larger number of LEL valves 134 than pre-packed CIM cartridges 136. For example, the engineered production liner 102 may include anywhere from about twice to about six times as many LEL valves 134 as pre-packed CIM cartridges 136, depending on the details of the specific implementation. In addition, according to the embodiment shown in FIG. 1, the joints including the pre-packed CIM cartridges 136 also include a number of perforations 138 that align with the pre-packed CIM cartridges 136. The perforations 138 allow the production fluid flowing through the pre-packed CIM cartridges 136 to enter the engineered production liner 102. In other embodiments, the perforations 138 may be replaced with slots, keyholes, or openings of any other size and shape that is suitable based on the desired inflow profiles, as described further herein.

The LEL valves 134 allow the pre-packed CIM cartridges 136 to be seamlessly integrated into the engineered production liner 102 without creating some of the issues that are caused by integrating pre-packed CIM cartridges into a typical LEL. Specifically, covering up the LEL holes in a typical LEL with pre-packed CIM cartridges slow the flow of the acid solution through the LEL holes and, thus, hinder the acid stimulation process. Moreover, slipping pre-packed CIM cartridges over the blank pipes next to the LEL holes in a typical LEL allow some production fluid to bypass the pre-packed CIM cartridges altogether and enter the liner through the LEL hole without absorbing any production chemicals. Accordingly, the engineered production liner 102 described herein is modified such that the one-directional LEL valves 134 allow the acid solution to jet from the well 100 into the reservoir 110 during the acid stimulation process, while forcing production fluid to flow through the pre-packed CIM cartridges 136 when the well 100 is put into production, as described in more detail with respect to FIGS. 2 and 3, respectively.

In addition, the engineered production liner 102 described herein is much more cost-effective than typical inflow control valves (ICVs) and other inflow control devices that might be utilized to control the flow of fluids between the well 100 and the reservoir 110. Typical ICVs require some form of power, such as power provided via a control line run from the surface, to operate. In contrast, the engineered production liner 102 described herein does not require any power because the LEL valves 134 are simple one-directional valves that operate based on the pressure differential between the well 100 and the reservoir 110. Moreover, as opposed to the LEL valves 134 described herein, typical ICVs do not include any mechanism for creating a high-velocity jet of acid solution directed at a reservoir, which is essential for effective acid stimulation.

Figure 2:
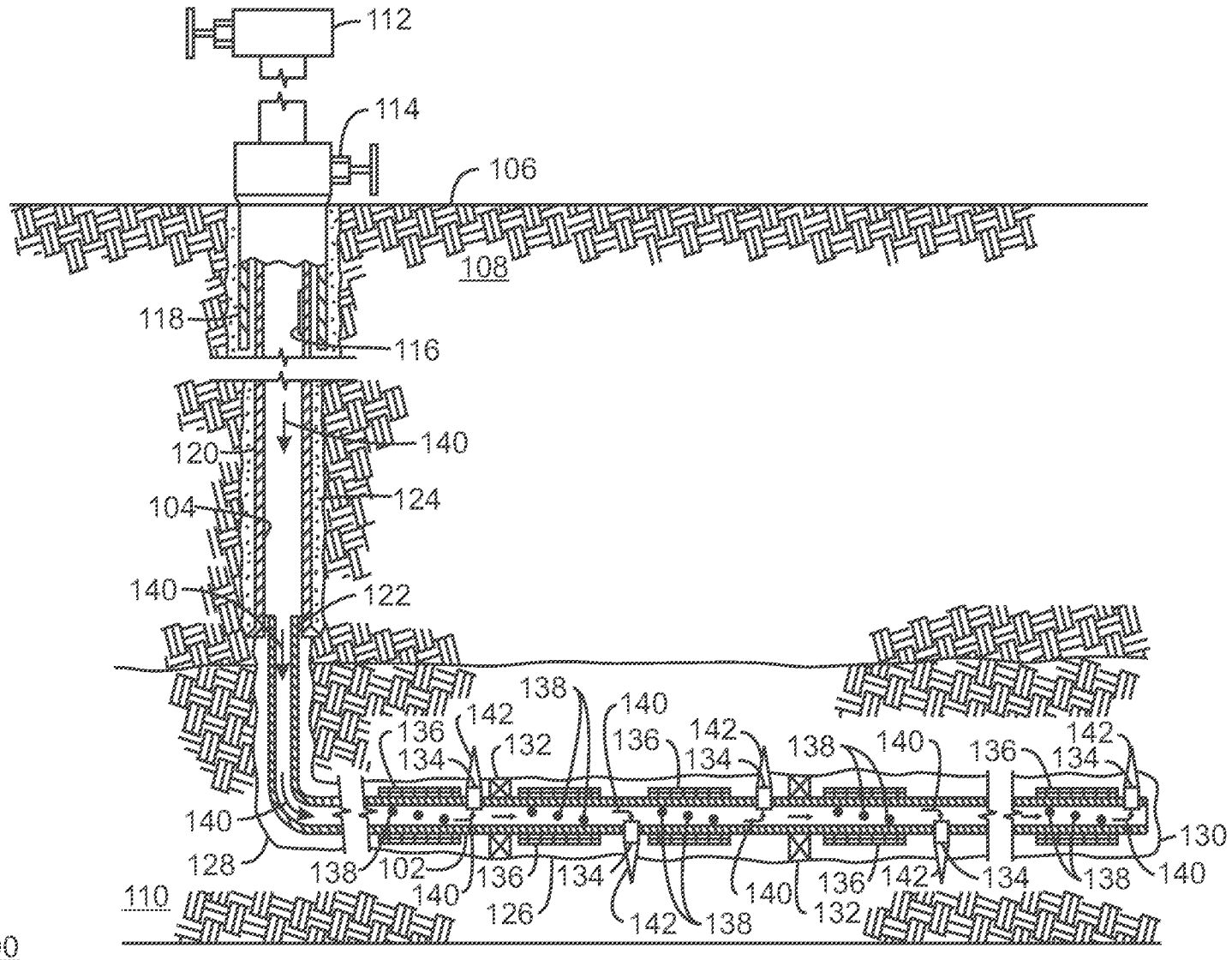
FIG. 2 is a cross-sectional schematic view of the well showing the function of the engineered production liner during an acid stimulation process.

FIG. 2 is a cross-sectional schematic view of the well 100 showing the function of the engineered production liner 102 during an acid stimulation process. The acid stimulation process may improve the flow of hydrocarbon fluids, generally referred to herein as "production fluid," from the reservoir 110 into the engineered production liner 102. This may be particularly beneficial for embodiments in which the well 100 is an extended-reach or ultra-extended-reach well and the reservoir 110 includes mostly carbonate rock layers. In operation, the acid stimulation process involves injecting an acid solution 140, such as a concentrated formic acid solution, for example, into the reservoir 110 via the engineered production liner 102. This is known as "acidizing." Acidizing helps to dissolve carbonate material, for example, within the reservoir 110, thereby opening up porous channels, generally referred to as "wormholes," through which production fluid may flow into the well 100. In addition, the acid solution 140 helps to dissolve drilling mud (and other drilling debris) that may have invaded the reservoir 110.

The first step of the acid stimulation process involves plugging the perforations 138 corresponding to the pre-packed CIM cartridges 136 with diversion material. The diversion material may include physical or mechanical diverters, such as bridge plugs, packers, fibers, or ball sealers, for example, or chemical diverters, such as salt granules, waxes, foam, viscous pills, and the like. In practice, the type of diversion material may be selected, at least in part, based on the size and shape of the openings in the engineered production liner 102, i.e., whether perforations, slots, keyholes, or some other openings are utilized. In various embodiments, plugging the perforations 138 with diversion material ensures that the acid solution 140 does not exit the engineered production liner 102 via the pre-packed CIM cartridges 136 but, rather, is forced through the LEL valves 134. In some embodiments, the diversion material simply dissolves away once the acid stimulation process is complete. In other embodiments, the diversion material returns to the wellhead 112 once the pressure within the well 100 decreases at the conclusion of the acid stimulation process.

Figure 3:
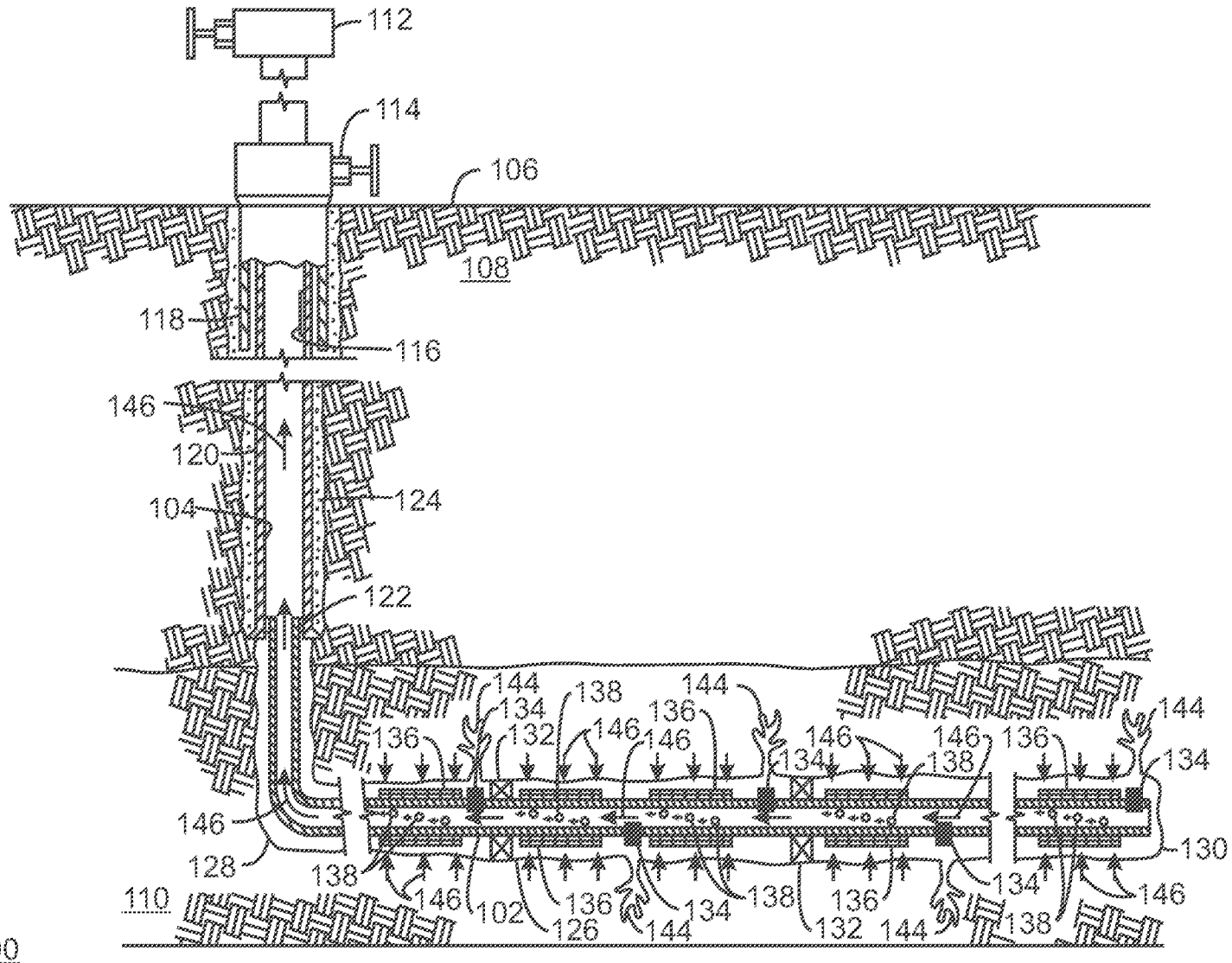
FIG. 3 is a cross-sectional schematic view of the well showing the function of the engineered production liner when the well is put into production.

The next step in the acid stimulation process involves pumping the acid solution 140 through the surface and intermediate casing strings 118 and 120 and into the engineered production liner 102. The injection of the acid solution 140 into the engineered production liner 102 causes a large pressure differential between the well 100 and the reservoir 110. This, in turn, causes the LEL valves 134 to open, resulting in high-velocity jets of the acid solution 140 into the reservoir 110, as shown at 142. In various embodiments, this results in the formation of wormholes 144 within the reservoir 110, as shown in FIG. 3. The wormholes 144 may substantially increase the amount of hydrocarbon fluids produced from the reservoir 110 by increasing the permeability of the reservoir 110 proximate to the engineered production liner 102.

In various embodiments, the injection rate for the acid solution 140 is specifically selected based on the threshold pressure differential at which the LEL valves 134 may open. In some embodiments, the LEL valves 134 are designed to open when the pressure differential exceeds around 1,000 pounds per square inch (psi). In such embodiments, the injection rate for the acid solution 140 may be set to about 60 barrels per minute (bpm), which may result in a pressure differential of around 2,750 psi at the heel 128 of the horizontal portion 126 and around 1,450 psi at the toe 130 of the horizontal portion 126. In other embodiments, the LEL valve 134 closest to the heel 128 is designed to open when the pressure differential exceeds around 1,000 psi, with the threshold pressure differential decreasing for each successive LEL valve 134 such that the LEL valve 134 closest to the toe 130 opens when the pressure differential exceeds around 500 psi. In such embodiments, the injection rate for the acid solution 140 may be set to about 40 bpm, resulting in a pressure differential of around 1,700 psi at the heel 128 and around 750 psi at the toe 130. This may be particularly useful if there is a concern about exceeding the fracture pressure within the reservoir 110 at higher injection rates. In various embodiments, maintaining the threshold pressure differential at around 1,000 psi ensures that the LEL valves 134 may open during the acid stimulation process but remain closed during a CIM recharge process, which is described further with respect to FIG. 4.

FIG. 3 is a cross-sectional schematic view of the well 100 showing the function of the engineered production liner 102 when the well 100 is put into production. Once the well is put into production, the pressure within the reservoir 110 exceeds the pressure within the well 100. As a result, the one-directional LEL valves 134 are closed, and all production fluid 146 flows through the pre-packed CIM cartridges 136 to enter the engineered production liner 102. As the production fluid 146 flows through the pre-packed CIM cartridges 136, it absorbs production chemicals that are useful for addressing a variety of production performance issues, as described with respect to FIG. 1. The types of production chemicals included within the pre-packed CIM cartridges 136 may vary based on the details of the specific implementation. For example, flow assurance chemicals, such as scale inhibitors, corrosion inhibitors, $H_2S$ scavengers, and/or asphaltene inhibitors, may be used to maintain suitable production rates within the well 100 and to protect the well 100 and other downstream equipment. As another example, chemical tracers, such as water-soluble and/or oil-soluble tracers, may be used to collect important information about the well 100 without the increased costs and risks associated with running a production logging tool (PLT) down the well 100. In this manner, the engineered production liner 102 may reduce the overall operating expenses associated with the well 100 by lowering the costs for flow assurance and production surveillance operations.

In some embodiments, the perforations 138 corresponding to the pre-packed CIM cartridges 136 are replaced with one-directional inflow valves (not shown) that permit the production fluid 146 to flow from the reservoir 110 into the engineered production liner 102, but prevent fluid flow in the opposite direction during the acid stimulation and CIM recharge processes. While this may increase the cost of the engineered production liner 102, it may also simplify the acid stimulation process, because diversion material may not be needed. The inflow valves may be the same as, or similar to, the LEL valves 134, except that the inflow valves and the LEL valves 134 are aligned in opposite directions.

Figure 4:
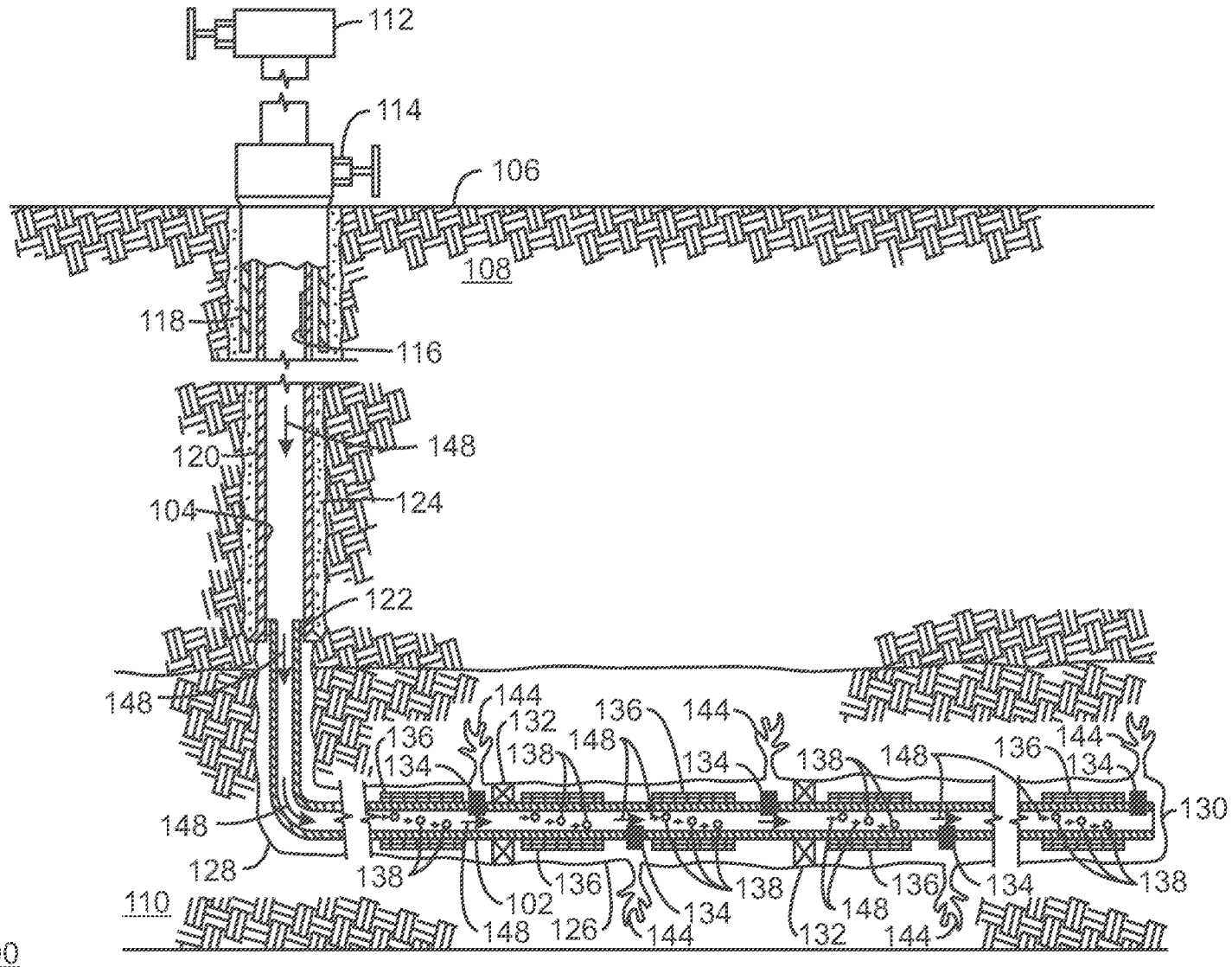
FIG. 4 is a cross-sectional schematic view of the well showing the function of the engineered production liner during a CIM recharge process.

FIG. 4 is a cross-sectional schematic view of the well 100 showing the function of the engineered production liner 102 during a CIM recharge process. After a certain period of time, the production chemicals within the chemically-infused material may become depleted. As a result, the pre-packed CIM cartridges 136 may no longer be useful for improving the production performance of the well 100. As a result, the CIM recharge process may be used to replenish the CIM with fresh production chemicals 148 in situ. The fresh production chemicals 148 may include the same type(s) of chemicals as previously used, or may include a new chemical (or combination of chemicals) to address new or different production performance issues.

In various embodiments, the recharge process involves pumping the fresh production chemicals 148 into the well 100 at a low injection rate, such that the pressure within the well 100 exceeds the pressure within the reservoir 110, but the pressure differential within the well 100 is still below the threshold pressure differential required to open the LEL valves 134. For example, in embodiments in which the threshold pressure differential for the LEL valves 134 is around 1,000 psi, the injection rate for the fresh production chemicals 148 may be maintained at around 6 bpm. At that injection rate, the pressure differential may be in a range between about 550 pounds per square inch (psi) and 770 psi at the heel 128 and in a range between about 0 psi and 160 psi at the toe 130, which is well below the threshold pressure differential for the LEL valves 134.

Because the LEL valves 134 remain closed during the CIM recharge process, the fresh production chemicals 148 are forced through the perforations 138 and into the pre-packed CIM cartridges 136. Once a full wellbore volume of the fresh production chemicals 148 has been pumped, the well 100 may be shut in to allow the fresh production chemicals 148 to soak and re-infuse into the chemically-infused material within the pre-packed CIM cartridges 136. The length of time that the well 100 is shut in may vary from a few hours to a few days, depending on the details of the specific implementation. After the recharging period is complete, the well 100 may be put back into production, as described with respect to FIG. 3.

In some embodiments, a multi-stage recharge process is used to replenish the production chemicals within the pre-packed CIM cartridges 136. This involves pumping the fresh production chemicals 148 to the first half of the pre-packed CIM cartridges 136, i.e., the ones closest to the heel 128. The perforations 138 associated with the first half of the pre-packed CIM cartridges 136 are then plugged with diversion material so that the fresh production chemicals 148 are able to reach the second half of the pre-packed CIM cartridges 136, i.e., the ones closest to the toe 130. This multi-stage recharge process may also be performed in three, four, five, or more stages, depending on the details of the specific implementation.

For embodiments in which the perforations 138 corresponding to the pre-packed CIM cartridges 136 are replaced with one-directional inflow valves, as described with respect to FIG. 3, the LEL valves 134 may be used to inject the fresh production chemicals 148 through the engineered production liner 102 into the reservoir 110. The fresh production chemicals 148 may then be backflowed through the pre-packed CIM cartridges 136 by putting the well 100 into production for a very short period of time before the well 100 is temporarily shut in to allow the fresh production chemicals 148 to soak and re-infuse into the chemically-infused material within the pre-packed CIM cartridges 136.

The cross-sectional schematic views of FIGS. 1-4 are not intended to indicate that the well 100 is to include all of the components shown in FIGS. 1-4. Moreover, the well 100 may also include any number of additional components not shown in FIGS. 1-4, depending on the details of the specific implementation. For example, while the well 100 is depicted as including the horizontal portion 126, it is to be understood that the well 100 may also be described as including additional horizontal portions, one or more vertical portions, and/or one or more deviated or highly-deviated portions that extend through multiple reservoirs or zones of interest. Furthermore, while the well 100 is described as an open-hole completion, in other embodiments, the well 100 may be a cased-hole completion in which the engineered production liner 102 is set in place using a cement sheath. Moreover, in some embodiments, the engineered production liner 102 is replaced with an engineered casing string that is hung from the surface rather than the bottom of the previous casing string.

While only five LEL valves 134 and five pre-packed CIM cartridges 136 are shown in FIGS. 1-4, this is for ease of discussion only, because a typical well may likely include a much larger number of LEL valves 134 and pre-packed CIM cartridges 136. In practice, the exact number of LEL valves 134 and pre-packed CIM cartridges 136 may vary based on a number of factors, such as the length of the horizontal portion 126. For example, in some embodiments, the engineered production liner 102 includes around 150 to 300 LEL valves 134 and around 25 to 75 pre-packed CIM cartridges 136.

The following section includes exemplary embodiments describing possible scenarios for utilizing the engineered production liner described herein to enhance acid stimulation and improve production performance within a well.

Exemplary Embodiment 1

In this exemplary embodiment, each pre-packed CIM cartridge is aligned with several perforations on the engineered production liner. When the well is stimulated, the perforations are plugged by ball sealers that are sized to fit the perforations. Specifically, a fluid containing the ball sealers is pumped into the well at a relatively low injection rate, so that the pressure differential between the well and the reservoir is not large enough to open the LEL valves. The ball sealers find and seal their targets, i.e., the perforations, effectively preventing any fluid from flowing through the pre-packed CIM cartridges during the acid stimulation process.

Once all the perforations are plugged, the pressure within the well may begin to increase. At this point, the acid stimulation package can be injected, and the pumping rate can be increased to the desired stimulation injection rate, which is typically around 20 barrels per minute (bpm) to 60 bpm. The high injection rate significantly increases the pressure differential between the well and the reservoir, crossing the threshold pressure differential for opening the LEL valves. When the LEL valves open, the acid solution is jetted into the formation.

After the acid stimulation process is complete, the pressure within the well is decreased to put the well into production. This causes the LEL valves to close and the ball sealers to flow back to the surface. With the LEL valves closed, production fluid from the reservoir is forced to flow through the pre-packed CIM cartridges to enter the engineered production liner and flow to the surface. As the production fluid flows through the pre-packed CIM cartridges, it absorbs production chemicals included within the chemically-infused material. The production chemicals may include a blend of oil-soluble and water-soluble tracers, where each pre-packed CIM cartridge includes a unique blend of the tracers so that the oil and water production rates specific to each pre-packed CIM cartridge and, thus, each section of the reservoir, can be deduced. This information may then be utilized to optimize the production performance of the well.

Exemplary Embodiment 2

This exemplary embodiment is the same as Exemplary Embodiment 1, except that the chemically-infused material includes scale inhibitor, corrosion inhibitor, asphaltene inhibitor, and/or $H_2S$ scavenger instead of (or in addition to) the chemical tracers.

Exemplary Embodiment 3

This exemplary embodiment is the same as Exemplary Embodiments 1 and 2, except that each pre-packed CIM cartridge is aligned with several slots on the engineered production liner, rather than the perforations. The slots are plugged during the acid stimulation process using fibers or other appropriate diversion material.

Exemplary Embodiment 4

This exemplary embodiment is the same as Exemplary Embodiments 1 and 2, except that the perforations corresponding to the pre-packed CIM cartridges are replaced with one-directional inflow valves that permit production fluid to flow from the reservoir into the engineered production liner. In this embodiment, no diversion material is needed during the acid stimulation process because the inflow valves may be closed when the well pressure exceeds the reservoir pressure. After the acid stimulation process is complete, the pressure within the well is decreased. As a result, the LEL valves close and the inflow valves within the pre-packed CIM cartridges open, allowing production fluid from the reservoir to flow through the pre-packed CIM cartridges and into the engineered production liner.

Exemplary Embodiment 5

This exemplary embodiment is an extension of Exemplary Embodiments 1-3. Eventually, the production chemicals within the pre-packed CIM cartridges may become depleted. The production chemicals may then be recharged in situ. Specifically, a fluid package containing fresh production chemicals is injected at a low injection rate, such that pressure differential between the well and the reservoir is not large enough to open the LEL valves. If the well is an extended-reach or ultra-extended-reach well, a multi-stage CIM recharge process may be used to ensure that the fresh production chemicals reach the pre-packed CIM cartridges closest to the toe. For example, a chemical volume sufficient to recharge the first half or first third, for example, of the pre-packed CIM cartridges may be pumped at a low rate. Diversion material may then be used to plug off the openings associated with the recharged pre-packed CIM cartridges, and a chemical volume sufficient to recharge the second half or second third, for example, of the pre-packed CIM cartridges may be pumped at a low rate. This process may be repeated until the fresh production chemicals reach all of the pre-packed CIM cartridges. Once the pumping of the fresh production chemicals is complete, the well is shut-in for a period of time to allow the fresh production chemicals to soak into the CIM within the pre-packed CIM cartridges.

Exemplary Embodiment 6

This exemplary embodiment is an extension of Exemplary Embodiment 4. Eventually, the production chemicals within the pre-packed CIM cartridges may become depleted. The production chemicals may then be recharged in situ. Specifically, a fluid package containing fresh production chemicals is injected at a high rate that is sufficient to trigger the opening of the LEL valves. The fresh production chemicals are jetted through the LEL valves into the reservoir. After the pumping of the fresh production chemicals is complete, the well is put into production for a very short period of time such that the fresh production chemicals backflow through the pre-packed CIM cartridges. The well is then shut-in for a period of time to allow the fresh production chemicals to soak into the CIM within the pre-packed CIM cartridges.

Exemplary Embodiment 7

This exemplary embodiment is the same as Exemplary Embodiments 1, 2, and 5, except that each pre-packed CIM cartridge is aligned with a keyhole on the engineered production liner, rather than the perforations. More particularly, each pre-packed CIM cartridge is associated with a uniquely-shaped keyhole, and each keyhole is sealed off by a solid diversion material of the correct shape. This may simplify the CIM recharge process. For example, if chemical tracers are included in the pre-packed CIM cartridges, then the specific pre-packed CIM cartridges that are producing water may be determined. The scale inhibitor in those specific pre-packed CIM cartridges may then be recharged by first pumping a diversion fluid containing only the keyholes for the pre-packed CIM cartridges that are producing dry oil, and then pumping a small chemical recharge package into the water-bearing pre-packed CIM cartridges.

Exemplary Embodiment 8

This exemplary embodiment is an extension of Exemplary Embodiment 4. In some cases, it may be desirable to include inflow valves that respond to specific pressure pulses, electromagnetic wave signals, or radio-frequency identification (RFID) tags. This may provide a mechanism for opening specific pre-packed CIM cartridges during the CIM recharge process, while the other pre-packed CIM cartridges remain closed. Similarly, if particular pre-packed CIM cartridges are producing too much water, those specific pre-packed CIM cartridges may be shut off while the other pre-packed CIM cartridges remain open to production.

Figure 5:
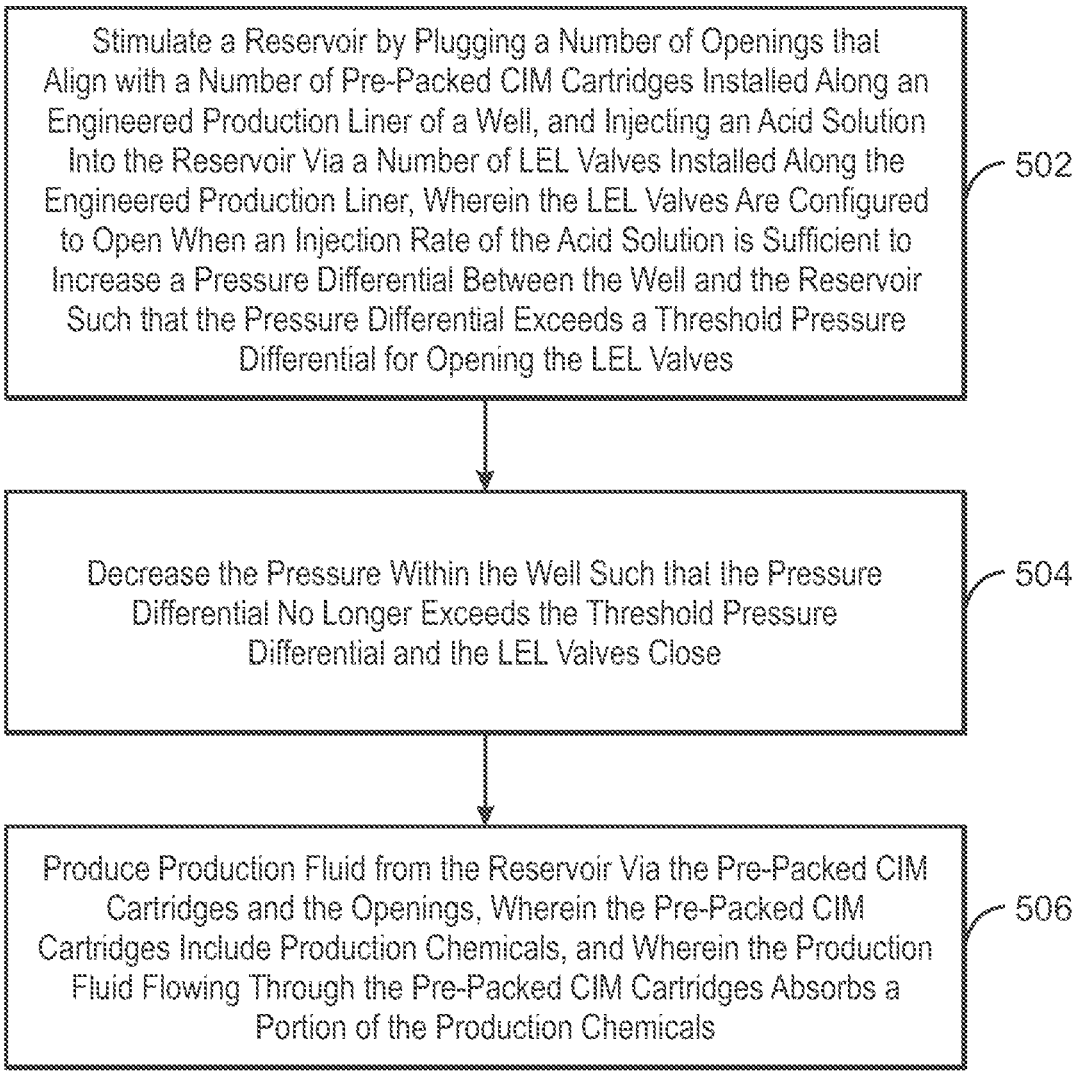
FIG. 5 is a process flow diagram of a method for enhancing acid stimulation and improving production performance within a well using an engineered production liner.

Method for Enhancing Acid Stimulation and Improving Production Performance within a Well Using an Engineered Production Liner FIG. 5 is a process flow diagram of a method 500 for enhancing acid stimulation and improving production performance within a well using an engineered production liner. The method 500 is implemented by an engineered production liner that extends along a portion, such as a horizontal or highly-deviated portion, of a well that is proximate to a reservoir. In some embodiments, the well is an extended-reach or ultra-extended-reach well.

The method 500 begins at block 502, at which the reservoir is stimulated by plugging a number of openings that align with a number of pre-packed chemically-infused material (CIM) cartridges installed along the engineered production liner, and injecting an acid solution into a reservoir via a number of limited-entry liner (LEL) valves installed along the engineered production liner. The LEL valves are configured to open when an injection rate of the acid solution is sufficient to increase a pressure differential between the well and the reservoir such that the pressure differential exceeds a threshold pressure differential for opening the LEL valves.

In various embodiments, the openings are plugged with diversion material. The diversion material may be selected based on the type of opening included in the well. For example, if the openings are perforations, the diversion material may include ball sealers. As another example, if the openings are slots, the diversion material may include fibers. Further, as another example, if the openings are uniquely-shaped keyholes corresponding to each pre-packed CIM cartridge, the diversion material may include solid diversion material that corresponds to each of the uniquely-shaped keyholes. In various embodiments, the diversion material dissolves away or returns to the wellhead once the pressure within the well decreases.

In other embodiments, each of the openings includes an inflow valve. The inflow valves are configured to close such that the openings are plugged when the well is being stimulated. The inflow valves are also configured to open when the pressure within the well decreases such that the openings are not plugged when the well is put into production.

At block 504, the pressure within the well is decreased such that the pressure differential no longer exceeds the threshold pressure differential and the LEL valves close. In various embodiments, after the pressure within the well is decreased, the pressure within the reservoir exceeds the pressure within the well. At this point, the well is ready for production.

At block 506, production fluid is produced from the reservoir via the pre-packed CIM cartridges and the openings. Moreover, the pre-packed CIM cartridges include production chemicals, and the production fluid flowing through the pre-packed CIM cartridges absorbs a portion of the production chemicals. The production chemicals may include at least one of a scale inhibitor, a corrosion inhibitor, an $H_2S$ scavenger, an asphaltene inhibitor, a water-soluble tracer, or an oil-soluble tracer. In various embodiments, the production chemicals may be selected based on particular production performance issues within the well.

The process flow diagram of FIG. 5 is not intended to indicate that the steps of the method 500 are to be executed in any particular order, or that all of the steps of the method 500 are to be included in every case. Further, any number of additional steps not shown in FIG. 5 may be included within the method 500, depending on the details of the specific implementation.

In some embodiments, the method 500 also includes replenishing the pre-packed CIM cartridges with fresh production chemicals via a CIM recharge process when the production chemicals within the pre-packed CIM cartridges become depleted. In some embodiments, the CIM recharge process includes maintaining the pressure differential below the threshold pressure differential during the CIM recharge process so that the LEL valves remain closed, and pumping the fresh production chemicals into the pre-packed CIM cartridges via the openings.

Alternatively, for embodiments in which each of the openings includes an inflow valve, the CIM recharge process may include injecting the fresh production chemicals into the well at a chemical injection rate that is sufficient to increase the pressure differential such that the pressure differential exceeds the threshold pressure differential and the LEL valves open, and allowing the fresh production chemicals to jet into the reservoir via the LEL valves. The pressure within the well may then be decreased such that the pressure differential no longer exceeds the threshold pressure differential and the LEL valves close, and the fresh production chemicals may be backflowed through the pre-packed CIM cartridges via the inflow valves. In various embodiments, the well is then shut-in for a period of time to allow the fresh production chemicals to soak into the pre-packed CIM cartridges. Further, in some embodiments, a multi-stage CIM recharge process is used to replenish the production chemicals within the pre-packed CIM cartridges.

In one or more embodiments, the present techniques may be susceptible to various modifications and alternative forms, such as the following embodiments as noted in paragraphs 1 to 39:

1. A well completion, comprising an engineered production liner extending into a reservoir, wherein the engineered production liner comprises: a plurality of limited-entry liner (LEL) valves configured to: open to allow an acid solution to jet into the reservoir during an acid stimulation process; and close to prevent production fluid from flowing through the plurality of LEL valves when the well completion is put into production; a plurality of pre-packed chemically-infused material (CIM) cartridges comprising production chemicals; a plurality of openings that align with the plurality of pre-packed CIM cartridges, wherein the plurality of openings are plugged during the acid stimulation process to force the acid solution to flow through the plurality of LEL valves; and wherein the plurality of pre-packed CIM cartridges and the plurality of openings are configured to allow the production fluid to absorb a portion of the production chemicals as the production fluid flows from the reservoir into the engineered production liner when the well completion is put into production.

2. The well completion of paragraph 1, wherein the well completion comprises an extended-reach well completion or an ultra-extended-reach well completion.

3. The well completion of paragraph 1 or 2, wherein the engineered production liner comprises a horizontal portion or a highly-deviated portion of the well completion.

4. The well completion of any of paragraphs 1 to 3, wherein the plurality of LEL valves are configured to: open when an injection rate of the acid solution is sufficient to increase a pressure differential between the well completion and the reservoir such that the pressure differential exceeds a threshold pressure differential for opening the plurality of LEL valves; and close when the pressure differential no longer exceeds the threshold pressure differential.

5. The well completion of any of paragraphs 1 to 4, wherein the plurality of openings are plugged with diversion material during the acid stimulation process.

6. The well completion of paragraph 5, wherein the plurality of openings comprise a plurality of perforations corresponding to each of the plurality of pre-packed CIM cartridges, and wherein the diversion material comprises a plurality of ball sealers or a plurality of fibers.

7. The well completion of paragraph 5, wherein the plurality of openings comprise a plurality of slots corresponding to each of the plurality of pre-packed CIM cartridges, and wherein the diversion material comprises a plurality of fibers.

8. The well completion of paragraph 5, wherein the plurality of openings comprise a uniquely-shaped keyhole corresponding to each of the plurality of pre-packed CIM cartridges, and wherein the diversion material comprises solid diversion material that corresponds to each of the uniquely-shaped keyholes.

9. The well completion of paragraph 5, wherein the diversion material dissolves away or returns to a wellhead of the well completion when the acid stimulation process is complete.

10. The well completion of any of paragraphs 1 to 9, wherein each of the plurality of openings comprises an inflow valve that is configured to: close during the acid stimulation process; and open when the well completion is put into production.

11. The well completion of paragraph 10, wherein the inflow valves respond to at least one of specific pressure pulses, electromagnetic wave signals, or radio-frequency identification (RFID) tags.

12. The well completion of any of paragraphs 1 to 11, wherein the plurality of pre-packed CIM cartridges are configured to be replenished with fresh production chemicals via a CIM recharge process when the production chemicals within the plurality of pre-packed CIM cartridges become depleted.

13. The well completion of paragraph 12, wherein the plurality of openings are configured to allow the fresh production chemicals to flow into the plurality of pre-packed CIM cartridges, and wherein the plurality of LEL valves are configured to remain closed during the CIM recharge process.

14. The well completion of paragraph 12, wherein the plurality of LEL valves are configured to allow the fresh production chemicals to jet into the reservoir, and wherein each of the plurality of openings comprises an inflow valve that is configured to allow the fresh production chemicals to backflow through the plurality of pre-packed CIM cartridges.

15. The well completion of paragraph 12, wherein the well completion is shut-in for a period of time to allow the fresh production chemicals to soak into the plurality of pre-packed CIM cartridges.

16. The well completion of paragraph 12, wherein a multi-stage CIM recharge process is used to replenish the production chemicals within the plurality of pre-packed CIM cartridges.

17. The well completion of any of paragraphs 1 to 16, wherein the production chemicals comprise at least one of a scale inhibitor, a corrosion inhibitor, an H2S scavenger, an asphaltene inhibitor, a water-soluble tracer, or an oil-soluble tracer.

18. The well completion of any of paragraphs 1 to 17, wherein the plurality of LEL valves and the plurality of pre-packed CIM cartridges are installed on adjacent joints of the engineered production liner.

19. A method for enhancing acid stimulation and improving production performance within a well using an engineered production liner, comprising: stimulating a reservoir by plugging a plurality of openings that align with a plurality of pre-packed chemically-infused material (CIM) cartridges installed along an engineered production liner of a well, and injecting an acid solution into a reservoir via a plurality of limited-entry liner (LEL) valves installed along the engineered production liner, wherein the plurality of LEL valves are configured to open when an injection rate of the acid solution is sufficient to increase a pressure differential between the well and the reservoir such that the pressure differential exceeds a threshold pressure differential for opening the plurality of LEL valves; decreasing a pressure within the well such that the pressure differential no longer exceeds the threshold pressure differential and the plurality of LEL valves close; and producing production fluid from the reservoir via the plurality of pre-packed CIM cartridges and the plurality of openings, wherein the plurality of pre-packed CIM cartridges comprise production chemicals, and wherein the production fluid flowing through the plurality of pre-packed CIM cartridges absorbs a portion of the production chemicals.

20. The method of paragraph 19, wherein the well comprises an extended-reach well or an ultra-extended-reach well.

21. The method of paragraph 19 or 20, wherein the engineered production liner comprises a horizontal portion or a highly-deviated portion of the well.

22. The method of any of paragraphs 19 to 21, comprising plugging the plurality of openings with diversion material.

23. The method of paragraph 22, wherein the plurality of openings comprise a plurality of perforations corresponding to each of the plurality of pre-packed CIM cartridges, and wherein the diversion material comprises a plurality of ball sealers or a plurality of fibers.

24. The method of paragraph 22, wherein the plurality of openings comprise a plurality of slots corresponding to each of the plurality of pre-packed CIM cartridges, and wherein the diversion material comprises a plurality of fibers.

25. The method of paragraph 22, wherein the plurality of openings comprise a uniquely-shaped keyhole corresponding to each of the plurality of pre-packed CIM cartridges, and wherein the diversion material comprises solid diversion material that corresponds to each of the uniquely-shaped keyholes.

26. The method of paragraph 22, comprising allowing the diversion material to dissolve away or return to a wellhead of the well once the pressure within the well decreases.

27. The method of any of paragraphs 19 to 26, wherein each of the plurality of openings comprises an inflow valve that is configured to: close such that a corresponding opening is plugged when the well is being stimulated; and open when the pressure within the well decreases.

28. The method of any of paragraphs 19 to 27, comprising replenishing the plurality of pre-packed CIM cartridges with fresh production chemicals via a CIM recharge process when the production chemicals within the plurality of pre-packed CIM cartridges become depleted.

29. The method of paragraph 28, wherein the CIM recharge process comprises: maintaining the pressure differential below the threshold pressure differential during the CIM recharge process so that the plurality of LEL valves remain closed; and pumping the fresh production chemicals into the plurality of pre-packed CIM cartridges via the plurality of openings.

30. The method of paragraph 28, wherein each of the plurality of openings comprises an inflow valve, and wherein the CIM recharge process comprises: injecting the fresh production chemicals into the well at a chemical injection rate that is sufficient to increase the pressure differential such that the pressure differential exceeds the threshold pressure differential and the plurality of LEL valves open; allowing the fresh production chemicals to jet into the reservoir via the plurality of LEL valves; decreasing the pressure within the well such that the pressure differential no longer exceeds the threshold pressure differential and the plurality of LEL valves close; and backflowing the fresh production chemicals through the plurality of pre-packed CIM cartridges via the inflow valves.

31. The method of paragraph 28, comprising shutting-in the well for a period of time to allow the fresh production chemicals to soak into the plurality of pre-packed CIM cartridges.

32. The method of paragraph 28, comprising using a multi-stage CIM recharge process to replenish the production chemicals within the plurality of pre-packed CIM cartridges.

33. The method of any of paragraphs 19 to 32, wherein the production chemicals comprise at least one of a scale inhibitor, a corrosion inhibitor, an H2S scavenger, an asphaltene inhibitor, a water-soluble tracer, or an oil-soluble tracer.

34. An engineered production liner, comprising: a plurality of limited-entry liner (LEL) valves configured to: open to allow an injected fluid to flow from an interior of the engineered production liner to an exterior of the engineered production liner when a pressure differential between the interior and the exterior exceeds a threshold pressure differential for opening the plurality of LEL valves; and close when the pressure differential no longer exceeds the threshold pressure differential; a plurality of pre-packed chemically-infused material (CIM) cartridges comprising production chemicals; and a plurality of openings that align with the plurality of pre-packed CIM cartridges; wherein the plurality of pre-packed CIM cartridges and the plurality of openings are configured to allow a production fluid to absorb a portion of the production chemicals as the production fluid flows from the exterior to the interior of the engineered production liner.

35. The engineered production liner of paragraph 34, wherein the injected fluid comprises an acid solution.

36. The engineered production liner of paragraph 34 or 35, wherein the plurality of openings comprise at least one of a plurality of perforations, a plurality of slots, or a keyhole corresponding to each of the plurality of pre-packed CIM cartridges.

37. The engineered production liner of any of paragraphs 34 to 36, wherein each of the plurality of openings comprises an inflow valve that is configured to: open to allow the production fluid to flow through a corresponding pre-packed CIM cartridge and a corresponding opening when a second pressure differential between the exterior and the interior of the engineered production liner exceeds a second threshold pressure differential for opening the inflow valve; and close when the second pressure differential no longer exceeds the second threshold pressure differential.

38. The engineered production liner of any of paragraphs 34 to 37, wherein the engineered production liner is configured such that the plurality of pre-packed CIM cartridges can be recharged with fresh production chemicals when the production chemicals within the plurality of pre-packed CIM cartridges become depleted.

39. The engineered production liner of any of paragraphs 34 to 38, wherein the plurality of LEL valves and the plurality of pre-packed CIM cartridges are installed on adjacent joints of the engineered production liner.

While the embodiments described herein are well-calculated to achieve the advantages set forth, it will be appreciated that the embodiments described herein are susceptible to modification, variation, and change without departing from the spirit thereof. Indeed, the present techniques include all alternatives, modifications, and equivalents falling within the true spirit and scope of the appended claims.

What is claimed is:

1. A well completion, comprising an engineered production liner extending into a reservoir, wherein the engineered production liner comprises:

a plurality of limited-entry liner (LEL) valves configured to:

open to allow an acid solution to jet into the reservoir during an acid stimulation process; and close to prevent production fluid from flowing through the plurality of LEL valves when the well completion is put into production;

a plurality of pre-packed chemically-infused material (CIM) cartridges comprising production chemicals;

a plurality of openings that align with the plurality of pre-packed CIM cartridges, wherein the plurality of openings are plugged during the acid stimulation process to force the acid solution to flow through the plurality of LEL valves, wherein the plurality of openings are configured to allow fresh production chemicals to flow into the plurality of pre-packed CIM cartridges, and wherein the plurality of LEL valves are configured to remain closed during a CIM recharge process; and wherein the plurality of pre-packed CIM cartridges and the plurality of openings are configured to allow the production fluid to absorb a portion of the production chemicals as the production fluid flows from the reservoir into the engineered production liner when the well completion is put into production.

2. The well completion of claim 1, wherein the plurality of LEL valves are configured to:

open when an injection rate of the acid solution is sufficient to increase a pressure differential between the well completion and the reservoir such that the pressure differential exceeds a threshold pressure differential for opening the plurality of LEL valves; and close when the pressure differential no longer exceeds the threshold pressure differential.

3. The well completion of claim 1, wherein the plurality of openings comprise a plurality of perforations corresponding to each of the plurality of pre-packed CIM cartridges, and wherein a diversion material comprises a plurality of ball sealers or a plurality of fibers.

4. The well completion of claim 1, wherein the plurality of openings comprise a plurality of slots corresponding to each of the plurality of pre-packed CIM cartridges, and wherein a diversion material comprises a plurality of fibers.

5. The well completion of claim 1, wherein each of the plurality of openings comprises an inflow valve that is configured to:

close during the acid stimulation process, and open when the well completion is put into production.

6. The well completion of claim 5, wherein the inflow valves respond to at least one of specific pressure pulses, electromagnetic wave signals, or radio-frequency identification (RFID) tags.

7. The well completion of claim 1, wherein the plurality of LEL valves are configured to allow fresh production chemicals to jet into the reservoir, and wherein each of the plurality of openings comprises an inflow valve that is configured to allow the fresh production chemicals to backflow through the plurality of pre-packed CIM cartridges.

8. The well completion of claim 1, wherein the plurality of LEL valves and the plurality of pre-packed CIM cartridges are installed on adjacent joints of the engineered production liner.

9. A method for enhancing acid stimulation and improving production performance within a well using an engineered production liner, comprising:

stimulating a reservoir by plugging a plurality of openings that align with a plurality of pre-packed chemically-infused material (CIM) cartridges installed along the engineered production liner of a well, and injecting an acid solution into a reservoir via a plurality of limited-entry liner (LEL) valves installed along the engineered production liner, wherein the plurality of LEL valves are configured to open when an injection rate of the acid solution is sufficient to increase a pressure differential between the well and the reservoir such that the pressure differential exceeds a threshold pressure differential for opening the plurality of LEL valves;

decreasing a pressure within the well such that the pressure differential no longer exceeds the threshold pressure differential and the plurality of LEL valves close; and producing production fluid from the reservoir via the plurality of pre-packed CIM cartridges and the plurality of openings, wherein the plurality of pre-packed CIM cartridges comprise production chemicals, and wherein the production fluid flowing through the plurality of pre-packed CIM cartridges absorbs a portion of the production chemicals;

replenishing the plurality of pre-packed CIM cartridges with fresh production chemicals via a CIM recharge process when the production chemicals within the plurality of pre-packed CIM cartridges become depleted; and shutting-in the well for a period of time to allow the fresh production chemicals to soak into the plurality of pre-packed CIM cartridges.

10. The method of claim 9, comprising plugging the plurality of openings with diversion material.

11. The method of claim 10, comprising allowing diversion material to dissolve away or return to a wellhead of the well once the pressure within the well decreases.

12. The method of claim 9, wherein the CIM recharge process comprises:

maintaining the pressure differential below the threshold pressure differential during the CIM recharge process so that the plurality of LEL valves remain closed; and pumping the fresh production chemicals into the plurality of pre-packed CIM cartridges via the plurality of openings.

13. The method of claim 9, wherein each of the plurality of openings comprises an inflow valve, and wherein the CIM recharge process comprises:

injecting the fresh production chemicals into the well at a chemical injection rate that is sufficient to increase the pressure differential such that the pressure differential exceeds the threshold pressure differential and the plurality of LEL valves open;

allowing the fresh production chemicals to jet into the reservoir via the plurality of LEL valves;

decreasing the pressure within the well such that the pressure differential no longer exceeds the threshold pressure differential and the plurality of LEL valves close; and backflowing the fresh production chemicals through the plurality of pre-packed CIM cartridges via the inflow valves.

14. An engineered production liner, comprising:

a plurality of limited-entry liner (LEL) valves configured to:

open to allow an injected fluid to flow from an interior of the engineered production liner to an exterior of the engineered production liner when a pressure differential between the interior and the exterior exceeds a threshold pressure differential for opening the plurality of LEL valves; and close when the pressure differential no longer exceeds the threshold pressure differential;

a plurality of pre-packed chemically-infused material (CIM) cartridges comprising production chemicals; and a plurality of openings that align with the plurality of pre-packed CIM cartridges wherein the plurality of openings are configured to allow fresh production chemicals to flow into the plurality of pre-packed CIM cartridges, and wherein the plurality of LEL valves are configured to remain closed during a CIM recharge process;

wherein the plurality of pre-packed CIM cartridges and the plurality of openings are configured to allow a production fluid to absorb a portion of the production chemicals as the production fluid flows from the exterior to the interior of the engineered production liner.

15. The engineered production liner of claim 14, wherein each of the plurality of openings comprises an inflow valve that is configured to:

open to allow the production fluid to flow through a corresponding pre-packed CIM cartridge and a corresponding opening when a second pressure differential between the exterior and the interior of the engineered production liner exceeds a second threshold pressure differential for opening the inflow valve; and close when the second pressure differential no longer exceeds the second threshold pressure differential.

16. The engineered production liner of claim 14, wherein the engineered production liner is configured such that the plurality of pre-packed CIM cartridges can be recharged with fresh production chemicals when the production chemicals within the plurality of pre-packed CIM cartridges become depleted.

17. A well completion, comprising an engineered production liner extending into a reservoir, wherein the engineered production liner comprises:

a plurality of limited-entry liner (LEL) valves configured to:

open to allow an acid solution to jet into the reservoir during an acid stimulation process; and close to prevent production fluid from flowing through the plurality of LEL valves when the well completion is put into production;

a plurality of pre-packed chemically-infused material (CIM) cartridges comprising production chemicals;

a plurality of openings that align with the plurality of pre-packed CIM cartridges, wherein the plurality of openings are plugged during the acid stimulation process to force the acid solution to flow through the plurality of LEL valves, wherein each of the plurality of openings comprises an inflow valve that is configured to:

close during the acid stimulation process; and open when the well completion is put into production; and wherein the inflow valves respond to at least one of specific pressure pulses, electromagnetic wave signals, or radio-frequency identification (RFID) tags; and wherein the plurality of pre-packed CIM cartridges and the plurality of openings are configured to allow the production fluid to absorb a portion of the production chemicals as the production fluid flows from the reservoir into the engineered production liner when the well completion is put into production.

18. A well completion, comprising an engineered production liner extending into a reservoir, wherein the engineered production liner comprises:

a plurality of limited-entry liner (LEL) valves configured to:

open to allow an acid solution to jet into the reservoir during an acid stimulation process; and close to prevent production fluid from flowing through the plurality of LEL valves when the well completion is put into production;

a plurality of pre-packed chemically-infused material (CIM) cartridges comprising production chemicals;

a plurality of openings that align with the plurality of pre-packed CIM cartridges, wherein the plurality of openings are plugged during the acid stimulation process to force the acid solution to flow through the plurality of LEL valves;

wherein the plurality of pre-packed CIM cartridges and the plurality of openings are configured to allow the production fluid to absorb a portion of the production chemicals as the production fluid flows from the reservoir into the engineered production liner when the well completion is put into production; and wherein the plurality of LEL valves are configured to allow fresh production chemicals to jet into the reservoir, and wherein each of the plurality of openings comprises an inflow valve that is configured to allow the fresh production chemicals to backflow through the plurality of pre-packed CIM cartridges.

19. A method for enhancing acid stimulation and improving production performance within a well using an engineered production liner, comprising:

stimulating a reservoir by plugging a plurality of openings that align with a plurality of pre-packed chemically-infused material (CIM) cartridges installed along an engineered production liner of a well, and injecting an acid solution into a reservoir via a plurality of limited-entry liner (LEL) valves installed along the engineered production liner, wherein the plurality of LEL valves are configured to open when an injection rate of the acid solution is sufficient to increase a pressure differential between the well and the reservoir such that the pressure differential exceeds a threshold pressure differential for opening the plurality of LEL valves;

decreasing a pressure within the well such that the pressure differential no longer exceeds the threshold pressure differential and the plurality of LEL valves close;

producing production fluid from the reservoir via the plurality of pre-packed CIM cartridges and the plurality of openings, wherein the plurality of pre-packed CIM cartridges comprise production chemicals, and wherein the production fluid flowing through the plurality of pre-packed CIM cartridges absorbs a portion of the production chemicals; and replenishing the plurality of pre-packed CIM cartridges with fresh production chemicals via a CIM recharge process when the production chemicals within the plurality of pre-packed CIM cartridges become depleted, wherein the CIM recharge process comprises:

maintaining the pressure differential below the threshold pressure differential during the CIM recharge process so that the plurality of LEL valves remain closed; and pumping the fresh production chemicals into the plurality of pre-packed CIM cartridges via the plurality of openings.

20. A method for enhancing acid stimulation and improving production performance within a well using an engineered production liner, comprising:

stimulating a reservoir by plugging a plurality of openings that align with a plurality of pre-packed chemically-infused material (CIM) cartridges installed along an engineered production liner of a well, and injecting an acid solution into a reservoir via a plurality of limited-entry liner (LEL) valves installed along the engineered production liner, wherein the plurality of LEL valves are configured to open when an injection rate of the acid solution is sufficient to increase a pressure differential between the well and the reservoir such that the pressure differential exceeds a threshold pressure differential for opening the plurality of LEL valves;

decreasing a pressure within the well such that the pressure differential no longer exceeds the threshold pressure differential and the plurality of LEL valves close;

producing production fluid from the reservoir via the plurality of pre-packed CIM cartridges and the plurality of openings, wherein the plurality of pre-packed CIM cartridges comprise production chemicals, and wherein the production fluid flowing through the plurality of pre-packed CIM cartridges absorbs a portion of the production chemicals; and replenishing the plurality of pre-packed CIM cartridges with fresh production chemicals via a CIM recharge process when the production chemicals within the plurality of pre-packed CIM cartridges become depleted, wherein each of the plurality of openings comprises an inflow valve, and wherein the CIM recharge process comprises:

injecting the fresh production chemicals into the well at a chemical injection rate that is sufficient to increase the pressure differential such that the pressure differential exceeds the threshold pressure differential and the plurality of LEL valves open;

allowing the fresh production chemicals to jet into the reservoir via the plurality of LEL valves;

decreasing the pressure within the well such that the pressure differential no longer exceeds the threshold pressure differential and the plurality of LEL valves close; and backflowing the fresh production chemicals through the plurality of pre-packed CIM cartridges via the inflow valves.

* * * * *